US009316145B2

(12) United States Patent
Imafuku

(10) Patent No.: US 9,316,145 B2
(45) Date of Patent: Apr. 19, 2016

(54) TWO-STROKE ENGINE

(71) Applicant: MAKITA CORPORATION, Aichi (JP)

(72) Inventor: Kenji Imafuku, Hanno (JP)

(73) Assignee: MAKITA CORPORATION, Aichi (JP)

( * ) Notice: Subject to any disclaimer, the term of this patent is extended or adjusted under 35 U.S.C. 154(b) by 49 days.

(21) Appl. No.: 14/373,670

(22) PCT Filed: Jan. 31, 2013

(86) PCT No.: PCT/JP2013/052204
§ 371 (c)(1),
(2) Date: Jul. 22, 2014

(87) PCT Pub. No.: WO2013/118635
PCT Pub. Date: Aug. 15, 2013

(65) Prior Publication Data

US 2015/0007802 A1 Jan. 8, 2015

(30) Foreign Application Priority Data

Feb. 10, 2012 (JP) ..... 2012-027405

(51) Int. Cl.
*F02B 17/00* (2006.01)
*F02B 25/00* (2006.01)
(Continued)

(52) U.S. Cl.
CPC ..... *F02B 25/00* (2013.01); *F02B 25/16* (2013.01); *F02F 1/22* (2013.01); *F02F 3/24* (2013.01); *F02B 2075/025* (2013.01); *F02M 25/06* (2013.01)

(58) Field of Classification Search
CPC ..... F02F 3/24; F02F 3/28; F02F 1/00; F02F 1/242; F02B 25/00; F02B 25/16; F02B 25/20; F02B 2700/037
USPC ..... 123/65 V, 65 VA, 65 PE, 306, 307, 309, 123/193.6, 661, 73 PP, 74 P
See application file for complete search history.

(56) References Cited

U.S. PATENT DOCUMENTS 1,587,585 A * 6/1926 Hansen ..... 123/65 A
2,190,011 A * 2/1940 Boxan ..... 123/65 A
(Continued)

FOREIGN PATENT DOCUMENTS

JP 57-122148 7/1982
JP 4-318220 11/1992
(Continued)

OTHER PUBLICATIONS

Search report from P.C.T., mail date is Apr. 23, 2013.

*Primary Examiner* — Marguerite McMahon
(74) *Attorney, Agent, or Firm* — Greenblum & Bernstein, P.L.C.

(57) ABSTRACT

There is provided a two-stroke engine configured to effectively prevent blow-by of the scavenging air from the discharge port and to be able to improve the engine output while abating pollution. The two-stroke engine includes a cylinder having an exhaust port and a scavenging port, and a piston, wherein: the piston has a top surface; a piston concave portion is provided in the top surface in the discharge direction; an entire surface of the piston concave portion is formed in an approximately spherical shape; and a slope of the piston concave portion extending from an outer circumferential edge of the piston concave portion in the discharge direction to a deepest portion is steeper than a slope of the piston concave portion extending from an outer circumferential edge of the piston concave portion in the anti-discharge direction to the deepest portion.

13 Claims, 15 Drawing Sheets

(51) Int. Cl.

| | |
|---|---|
| ***F02F 1/22*** | (2006.01) |
| ***F02F 3/24*** | (2006.01) |
| ***F02B 25/16*** | (2006.01) |
| *F02B 75/02* | (2006.01) |
| *F02M 25/06* | (2006.01) |

(56) References Cited

U.S. PATENT DOCUMENTS

| | | | | |
|---|---|---|---|---|
| 5,020,485 | A * | 6/1991 | Watanabe | 123/73 C |
| 5,832,881 | A * | 11/1998 | Karay et al. | 123/65 PE |
| 6,338,327 | B1 * | 1/2002 | Ogi et al. | 123/257 |
| 6,415,748 | B2 * | 7/2002 | Uchida et al. | 123/65 PE |
| 6,581,553 | B2 | 6/2003 | Morikawa et al. | |
| 8,707,928 | B2 | 4/2014 | Sugiyama et al. | |
| 2001/0054398 | A1 | 12/2001 | Morikawa et al. | |
| 2014/0182571 | A1 | 7/2014 | Takayanagi et al. | |

FOREIGN PATENT DOCUMENTS

| | | |
|---|---|---|
| JP | 2002-004865 | 1/2002 |
| JP | 2005-233064 | 9/2005 |

* cited by examiner

TWO-STROKE ENGINE

TECHNICAL FIELD

The present invention relates to a two-stroke engine.

BACKGROUND ART

Conventionally, a small two-stroke engine has been well known, which includes a cylinder with an exhaust port and a scavenging port that allows scavenging air (fresh charge) containing at least fuel and air to be supplied to the inner side surface of the cylinder opposite to the exhaust port (hereinafter referred to as "schnurle-type two-stroke engine").

Generally, such a schnurle-type two-stroke engine is configured to open and close the discharge port and the scavenging port by the reciprocating motion of a piston to allow the scavenging air to flow into the cylinder and to allow the exhaust gas to be discharged from the cylinder.

This schnurle-type two-stroke engine has a simple structure, and therefore part of the scavenging air having flowed into the cylinder via the exhaust port is often discharged from the exhaust port without being combusted by a spark plug, which is called "blow-by phenomenon". In this case, deleterious components contained in the exhaust gas discharged from the exhaust port increase, and then are discharged from the exhaust port. This causes a problem that the charging efficiency deteriorates and the engine output is reduced.

To address the problem, for example, a schnurle-type two-stroke engine including a piston top surface on which a groove having an approximately arc cross section is formed, has been proposed (see Patent Literature 1).

With this schnurle-type two-stroke engine disclosed in Patent Literature 1, the groove formed on the piston top surface can allow the scavenging air (containing residual gas) having flowed from the exhaust port to successfully tumble. As a result, the scavenging air exhibits swirl motion in the cylinder, and therefore it is possible to prevent the above-described blow-by phenomenon from occurring.

CITATION LIST

Patent Literature

PTL1: Japanese Patent Application Laid-Open No. 2005-233064

SUMMARY OF INVENTION

Technical Problem

Here, generally, there are various types of scavenging air which are discharged as blow-by, for example, scavenging air that swirls in the cylinder and then is discharged from the exhaust port; scavenging air that does not create a tumble flow (toward the cylinder head) but is directly discharged from the exhaust port; and scavenging air that has created a tumble flow once but has not reached the cylinder head and is discharged from the exhaust port, and so forth.

That is, the schnurle-type two-stroke engine disclosed in Patent Literature 1 can prevent the blow-by of the scavenging air that exhibits swirl motion, but is not configured for the other types of scavenging air, and therefore has a problem of not enough to prevent blow-by.

Solution to Problem

It is therefore an object of the present invention to provide a two-stroke engine that can efficiently prevent the blow-by of scavenging air to improve the engine output while abating pollution.

The two-stroke engine according to the present invention includes: a cylinder formed in an approximately cylindrical shape; and a piston that can reciprocate between a top dead center and a bottom dead center in the cylinder, the cylinder including: an exhaust port configured to be able to discharge exhaust gas; and a scavenging port configured to be able to deliver scavenging air containing fuel and air in an anti-discharge direction approximately opposite to a discharge direction of the exhaust gas, wherein: the piston has a top surface, part of the top surface being concave as a piston concave portion; the piston concave portion is provided in the top surface in the discharge direction; an entire surface of the piston concave portion is formed in an approximately spherical shape; and a slope of the piston concave portion extending from an outer circumferential edge of the piston concave portion in the discharge direction to a deepest portion is steeper than a slope of the piston concave portion extending from an outer circumferential edge of the piston concave portion in the anti-discharge direction to the deepest portion.

It is preferred that the cylinder includes a cylinder concave portion that is formed in an opposite surface facing a top surface of the piston, the cylinder concave portion is concave in a direction in which the piston moves to the top dead center.

It is preferred that the outer periphery of the cylinder concave portion is formed in the position in which the outer periphery of the cylinder concave portion approaches the outer periphery of the piston concave portion when the piston reaches the top dead center.

It is preferred that the cylinder concave portion is formed in an approximately spherical shape.

It is preferred that the piston includes a piston extending surface in the top surface, the piston extending surface extending from the outer circumference edge of the piston concave portion in the anti-discharge direction; and the cylinder includes a cylinder extending surface in the opposite surface, the cylinder extending surface extending from the outer circumferential edge of the cylinder concave portion in the anti-discharge direction, and having a gap that is formed between the cylinder extending surface and the piston extending surface when the piston reaches the top dead center.

It is preferred that the gap is sized to generate a squish flow.

It is preferred that a mounting part is formed in the cylinder concave portion, the mounting part being configured to allow a spark plug to be mounted from an outside of the cylinder.

It is preferred that the mounting part is formed in the anti-discharge direction with respect to a center of the cylinder concave portion.

It is preferred that a wall surface is formed in the exhaust port to close at least part of a center portion of the discharge port in a width direction.

Effect of the Invention

With the present invention, it is possible to effectively prevent the blow-by of scavenging air. As a result, the trapping efficiency, the scavenging efficiency and the charging efficiency are improved, and therefore it is possible to improve the engine output and the gas mileage (thermal efficiency) while abating pollution.

DESCRIPTION OF EMBODIMENTS

<Embodiment 1>

Hereinafter, a two-stroke engine 1 according to the present invention will be described with reference to FIGS. 1 to 5. Here, the two-stroke engine 1 according to the present embodiment is small to be carried, and therefore its posture in use can be changed. However, usually, the most common posture in use would be determined. That is, several postures would be possible, for example, the two-stroke engine 1 is used upside down, steeply inclined, and so forth. However, the two-stroke engine 1 is designed for which it is used in a standard posture much of the time. Then, although temporarily using the two-stroke engine 1 in different postures, the user usually uses it in the posture according to the standard design.

Hereinafter, although the two-stroke engine having a piton that reciprocates in a vertical direction will be described, it is by no means limiting. The present invention is applicable to a two-stroke engine with a piston that reciprocates in a horizontal direction or an oblique direction.

Figure 1:
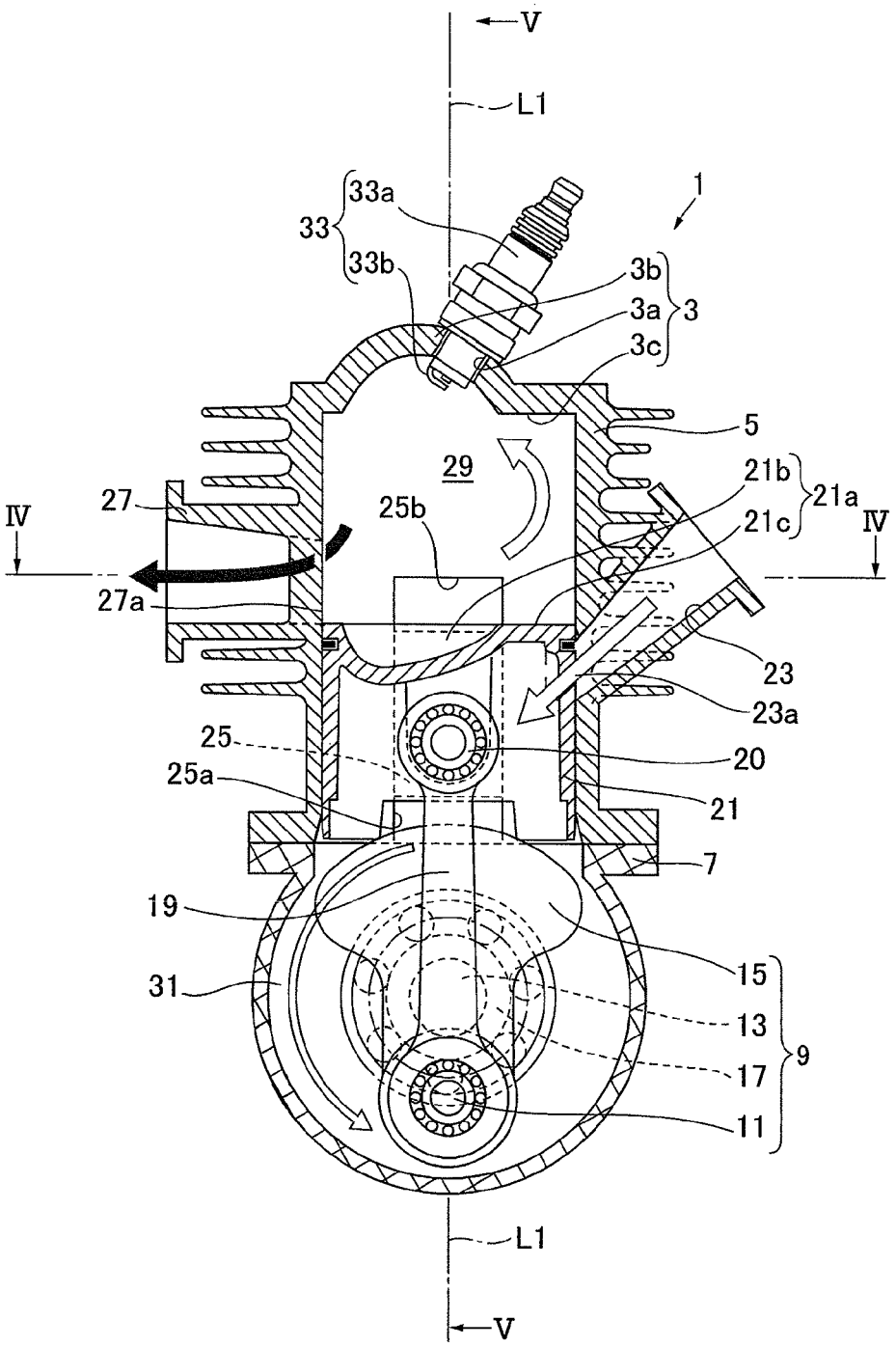
FIG. 1 is a cross-sectional view showing a two-stroke engine according to Embodiment 1 of the present invention.

As shown in FIG. 1, the two-stroke engine 1 includes a cylinder 5, a crankcase 7, a piston 21 and a connecting rod 19.

A crank chamber 31 is defined by the cylinder 5, the crankcase 7 and the piston 21. That is, the crank chamber 31 is an approximately cylindrical space defined by the inner periphery of the cylinder 5 and the piston 21 in the crankcase 7 side (hereinafter referred to as "lower side"). The capacity of the inner space of the crank chamber 31 is changed as the piston 21 reciprocates.

A crank chamber scavenging port 25*a* is open in the crank chamber 31 that allows scavenging air containing at least air and fuel to be delivered to a scavenging passage 25. In addition, the scavenging air from the scavenging passage 25 flows into an intra-cylinder space 29 that is defined by the inner periphery of the cylinder 5 and a top surface 21*a* of the piston 21 described later, via a scavenging port 25*b* formed in the cylinder 5. Here, "scavenging air" means part of the gas having flowed into the intra-cylinder space 29 via the crank chamber scavenging port 25*a*, which has not been combusted in a combustion chamber 30 (see FIG. 3). Hereinafter, part of the gas having flowed into the intra-cylinder space 29, which has been combusted in the combustion chamber 30, will be referred to as "combustion gas".

A crankshaft 9 is rotatably supported in the crank chamber 31. The crankshaft 9 includes a crank pin 11, a crank journal 13, a counter weight 15 and a crank arm 17. The lower part of the connecting rod 19 faces the counter weight 15, and the connecting rod 19 is rotatably supported by the crank pin 11. In addition, the piston 21 is slidably supported by the part of the connecting rod 19 in the cylinder head 3 side (hereinafter referred to as "upper side") via a piston pin 20. The piston pin 20 is provided at a position on or near bore center line L1 while supporting the piston 21. This piston 21 supported by the piston pin 20 slidably reciprocates between the bottom dead center (see FIG. 2) and the top dead center (see FIG. 3) in the cylinder 5.

Here, the piston 21 will be explained with reference to FIGS. 2 to 5. As shown in FIGS. 2 to 5, the piston 21 has the top surface 21*a* that includes a piston concave portion 21*b* and a piston extending surface 21*c*. The piston concave portion 21*b* is provided in the discharge port 27*a* side, that is, in the direction in which exhaust gas is discharged (hereinafter referred to as "discharge direction"), with respect to the bore center line L1, and is concave downward. Meanwhile, the piston extending surface 21*c* is provided to extend from the outer circumferential edge of the piston concave portion 21*b* in the direction opposite to the discharge direction (hereinafter referred to as "anti-discharge direction") and is formed in an approximately planar shape.

The piston concave portion 21*b* is formed in an approximately circular shape in planar view, and its entire surface is formed in an approximately spherical shape. The piston concave portion 21*b* includes a deepest portion 21*b*-3 formed to be deepest; a steep slope portion 21*b*-1 formed to have a steep slope from the outer circumferential edge of the piston concave portion 21*b* in the discharge direction to the deepest portion 21*b*-3; and a gentle slope portion 21*b*-2 formed to have a slope from the outer circumferential edge of the piston concave portion 21*b* in the anti-discharge direction to the deepest portion 21*b*-3, which is more gentle than the steep slope portion 21*b*-1. In addition, the piston concave portion 21*b* has the top surface and the back surface which are an approximately parallel to one another, and has a thickness that is an approximately the same as of the piston extending surface 21*c*.

Figure 3:
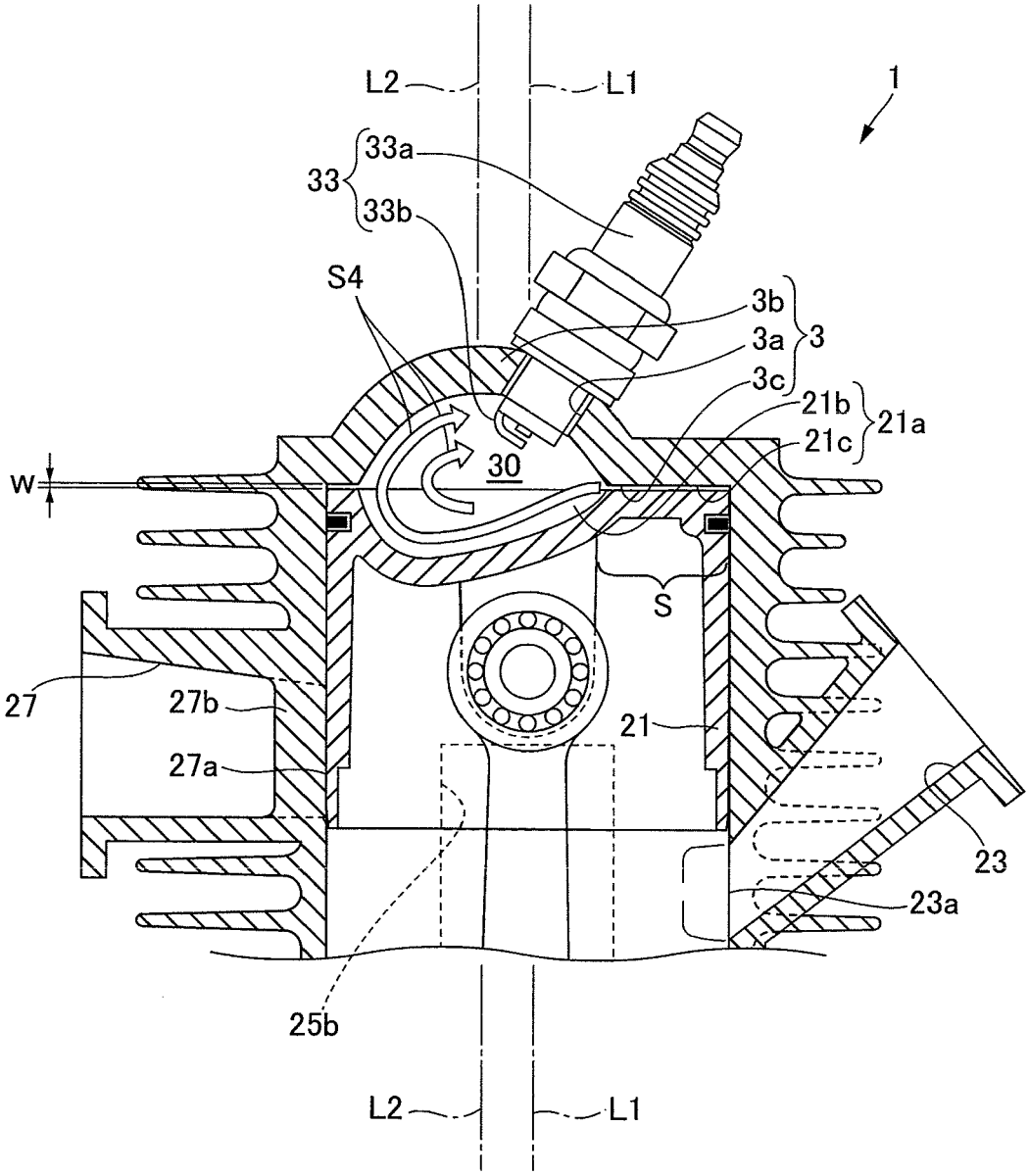
FIG. 3 is a cross-sectional view showing enlarged primary parts when the piston shown in FIG. 1 reaches the top dead center.

As shown in FIG. 3, half or more of the piston concave portion 21*b* is formed in the discharge direction with respect to the bore center line L1, in its diameter direction. In addition, the outer circumferential edge of the piston concave portion 21*b* in the discharge direction is formed to approach the exhaust port 27*a*.

Next, the cylinder 5 will be explained with reference to FIGS. 1 to 5. As shown in FIGS. 1 to 5, the cylinder 5 includes the cylinder head 3 in its upper part. Here, the cylinder head 3 is not necessarily separated from the cylinder 5, but maybe formed integrally with the cylinder 5 as shown in FIG. 1 and so forth.

An intake port 23*a* is formed in the lower part of the cylinder 5. An intake passage 23 is provided in the cylinder 5, which allows intake air having passed through a carburetor (not shown) to flow into the crank chamber 31 via the intake port 23*a*. In addition, this intake passage 23 is formed form top down and toward the bore center line L1 of the cylinder 5.

With the present embodiment, the crankshaft 9 rotates counterclockwise in FIG. 1. That is, the crankshaft 9 rotates in the direction in which the intake air having entered from the intake port 23*a* flows. In other words, in the state shown in FIG. 1, when a line is drawn from the intake port 23*a* to the counterweight 15 of the crankshaft 9, the direction of the line coincides with the rotating direction of the crankshaft 9.

With this configuration, the rotation of the crankshaft 9 (particularly, the counter weight 15) allows the intake air to smoothly flow from the intake port 23*a* to the crank chamber 31.

In addition to the intake port 23*a*, the scavenging port 25*b* and the exhaust port 27*a* are formed in the cylinder 5.

Figure 4:
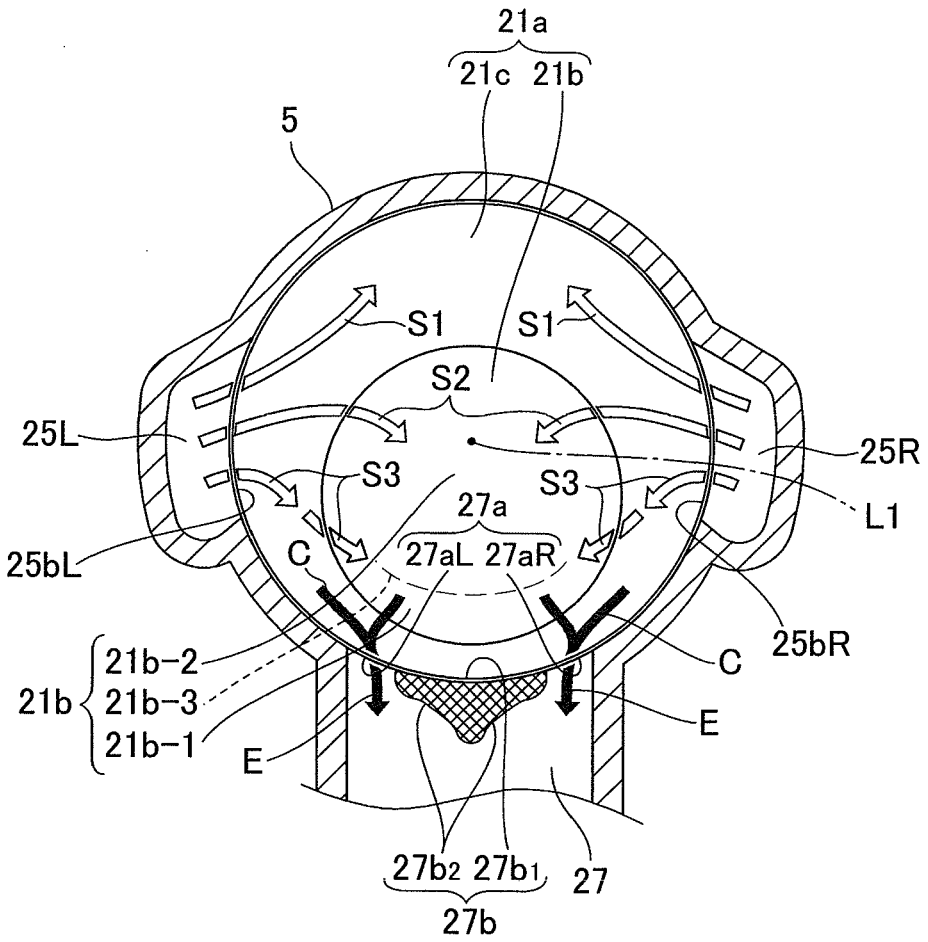
FIG. 4 is a cross-sectional view of FIG. 1 taken along line IV-IV.
Figure 5:
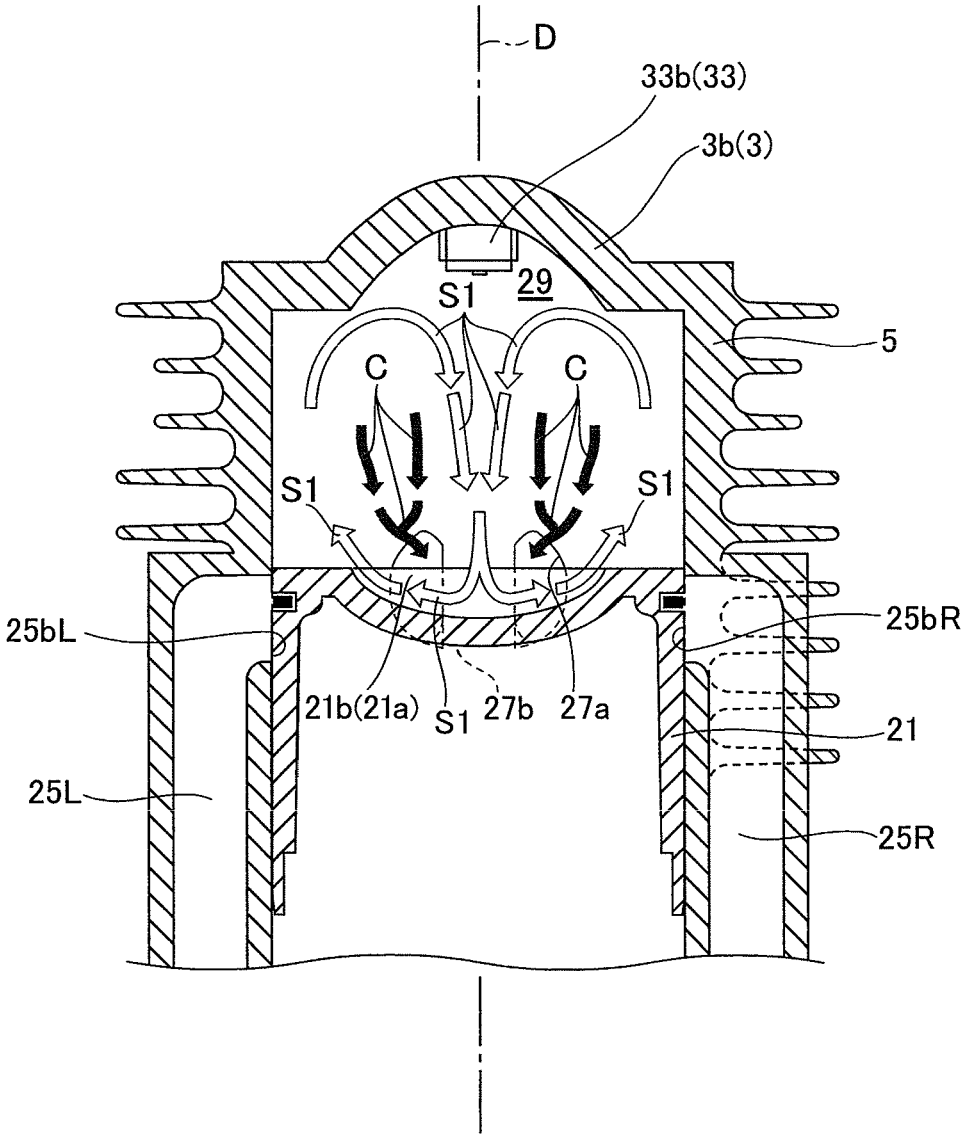
FIG. 5 is a cross-sectional view of FIG. 1 taken along line V-V.

As shown in FIGS. 1, 4 and 5, the scavenging port 25*b* communicates with the crank chamber scavenging port 25*a* that is open in the crank chamber 31, via the scavenging passage 25. The scavenging passage 25 is constituted by two passages. As shown in FIG. 4, a right scavenging passage 25R is located in the right side with respect to the bore center line L1 of the cylinder 5, and a left scavenging passage 26L is located in the left side with respect to the bore center line L1. The right scavenging passage 25R and the left scavenging passage 25L extend from the back to the front of FIG. 4. Scavenging air passes through the scavenging passage 25, the right scavenging port 25*b*R and the left scavenging port 25*b*L, and then flows into the intra-cylinder space 29. Here, with the present embodiment, a configuration is explained as an example, where the present invention is applied to a two-stroke engine with two-port scavenging realized by the scavenging passages 25 provided in the right and left sides respectively, but it is by no means limiting. A two-stroke engine with four-port scavenging (in which two scavenging passages are provided in each of the right and left sides), a two-stroke engine with six-port scavenging (in which three scavenging ports are provided in each of the right and left sides), and another type of two-stroke engine is applicable.

As shown in FIG. 1 and FIG. 5, the scavenging passage 25 extends along the bore center line L1 of the cylinder 5 and has the scavenging port 25*b* that is open in the cylinder 5, so that the scavenging air flowing from the scavenging port 25*b* has an upward direction component. In addition, the schnurle-type two-stroke engine 1 is configured to flow the scavenging air toward the side surface of the cylinder 5, which is opposite to the exhaust port 27*a*. Therefore, as shown in FIG. 4, the scavenging air flowing from the scavenging port 25*b* into the cylinder 5 is toward the upward direction (anti-discharge direction) with respect to the bore center line L1 of the cylinder 5. That is, as shown in FIG. 4, the scavenging air entering from the scavenging port 25*b* into the cylinder 5 flows toward the side surface in the anti-discharge direction with respect to the bore center line L1 of the cylinder 5, which is the upper side surface shown in FIG. 2. After that, the scavenging air having flowed into the cylinder 5 hits the side surface in the discharge direction with respect to the bore center line L1 of the cylinder 5 (the lower side surface shown in FIG. 4), which is the upper side surface shown in FIG. 2, and therefore circulates in the intra-cylinder space 29. Moreover, at least part of the scavenging air having circulated comes down along a wall surface 27*b* described later, and further circulates.

Figure 2:
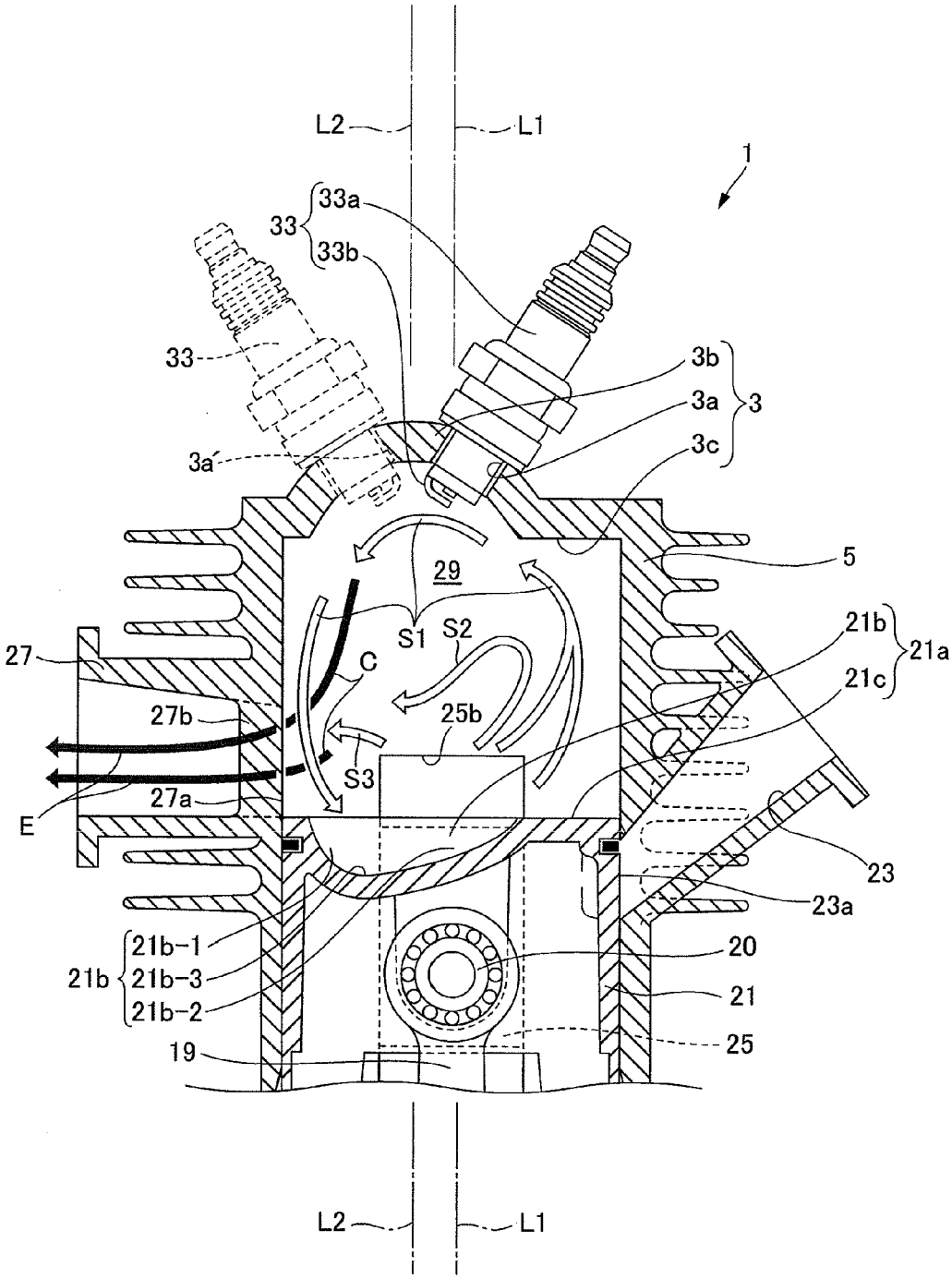
FIG. 2 is a cross-sectional view showing enlarged primary parts when the piston shown in FIG. 1 reaches the bottom dead center.

Meanwhile, as shown in FIGS. 2 and 4, the exhaust port 27*a* is formed in the level higher than the scavenging port 25*b* (the right scavenging port 25*b*R and the left scavenging port 25*b*L). Combustion gas C combusted in the combustion chamber 30 (see FIG. 3) is discharged from the exhaust passage 27 via the exhaust port 27*a* as exhaust gas E. By this means, with the present embodiment, when the piston 21 comes down from the top dead center to the bottom dead center, a port timing is set such that the exhaust port 27*a* first opens, and next the scavenging port 25*b* opens.

As described above, the exhaust port 27*a* is formed in the upper part, and therefore the exhaust passage 27 (exhaust port 27*a*) first communicates with the intra-cylinder space 29 as the piston 21 moves toward the bottom dead center. As a result, the combustion gas C in the intra-cylinder space 29 is discharged from the upper part of the exhaust port 25*a* to the outside of the cylinder 5 as the exhaust gas E. Then, the combustion gas C remaining in the intra-cylinder space 29 is discharged to some extent via the exhaust port 27*a*, while the piston 21 moves to the bottom dead center. Since the pressure in the intra-cylinder space 29 decreases because of the discharge of the combustion gas C, the right scavenging air passage 25R (right scavenging port 25*b*R) and the left scavenging air passage 25L (left scavenging port 25*b*L) communicate with the intra-cylinder space 29. By this, in the state in which the combustion gas C that was combusted in the previous combustion cycle was discharged from the exhaust port 27*a* as the exhaust gas E, S1 to S3 flows of the scavenging air flow into the cylinder 5. Therefore, it is possible to more efficiently discharge the exhaust gas E.

As shown in FIGS. 4 and 5, the wall surface 27*b* is formed in the exhaust port 27*a* that can separate and guide the exhaust gas E to the right side and the left side. Viewed from the bore center line L1 side, the wall surface 27*b* has a Y shape (see FIG. 5). This wall surface 27*b* forms a left exhaust port 27*a*L on its left side. Meanwhile, the wall surface 27*b* forms a right exhaust port 27*a*R on its right side.

Moreover, the wall surface 27*b* has an approximately triangular cross section in the bore direction (see FIG. 4). The shape of a side 27*b*1 which is one side of the approximate triangle coincides the shape of the inner periphery of the cylinders. Here, with the present embodiment, the wall surface 27*b* has a Y shape, viewed from the bore center line L1, but it is by no means limiting. The wall surface 27*b* may have an I shape and another shape.

Here, flows of scavenging air in the intra-cylinder space 29 will be explained with reference to FIGS. 2 and 5. Most of the flows of scavenging air in the intra-cylinder space 29 rises along both sides of the inner periphery of the cylinder 5, as flows S1 in FIGS. 2 and 5, and then the flows join at the center of the inner periphery of the cylinder head 3 and flow down to the top surface 21*a* of the piston 21.

Therefore, if the wall surface 27*b* is not provided in the exhaust port 27*a* unlike the present embodiment, it is difficult to prevent the scavenging air from being directly discharged from the exhaust port 27*a*, which is a so-called blow-by phenomenon, because the exhaust port 27*a* is formed above the flow S1 of scavenging air coming down. However, with the present embodiment, the wall surface 27*b* is provided above the flow S1 of scavenging air coming down, and therefore it is possible to effectively prevent blow-by of the scavenging air, and to effectively guide the scavenging air to the top surface 21*a* of the piston 21. In this way, the scavenging air having passed through the center part (wall surface 27*b*) of the exhaust port 27*a* reaches the top surface 21*a* of the piston 21, and is successfully guided to the inner surface of the cylinder 5 in the anti-discharge direction by the piston concave portion 21*b* formed in an approximately spherical shape. By this means, the scavenging air remains the intra-cylinder space 29 without blow-by.

Next, the cylinder head 3 will be explained with reference to FIGS. 1 to 3. As shown in FIGS. 1 to 3, the cylinder head 3 includes a cylinder concave portion 3*b* that is concave upward in its discharge direction and a cylinder extending surface 3*c* that is formed in a flat shape and that extends from the outer circumferential edge of the cylinder concave portion 3*b* to the anti-discharge direction.

The entire inner periphery of the cylinder concave portion 3*b* is formed in an approximately spherical shape, and the inner periphery and the outer periphery of the cylinder concave portion 3*b* are parallel to one another. The outer circumferential edge of the inner periphery of the cylinder concave portion 3*b* approaches the outer circumferential edge of the piston concave portion 21*b* when the piston 21 reaches the top dead center. That is, in the state in which the piston 21 reaches the top dead center, the cylinder concave portion 3*b* and the piston concave portion 21*b* form an approximately oval spherical space.

In addition, the cylinder extending surface 3*c* faces the piston extending surface 21*c*, so that gap W of, for example, about 1 mm is formed between the cylinder extending surface 3*c* and the piston extending surface 21*c* when the piston 21 reaches the top dead center (see FIG. 3).

Therefore, when the piston 21 reaches the top dead center, area S is formed with the predetermined gap W between the cylinder extending surface 3*c* and the piston extending surface 21*c*, so that it is possible to generate a strong squish flow from the area S to the combustion chamber 30.

Moreover, a mounting hole 3*a* is formed on the cylinder head 3 at a position on or near the bore center line 1. The mounting hole 3*a* allows the spark plug 33 to be mounted from the outside of the cylinder 5.

In the state in which the spark plug 33 is mounted on the cylinder head 3, an electrode part 33*b* is disposed in the combustion chamber 30 while a spark plug body 33*a* is exposed to the outside.

Next, with reference to FIGS. 2 to 5, flows of the scavenging air in the two-stroke engine 1 will be explained for two cases: when the piston 21 is located in the bottom dead center; and the piston 21 moves to the top dead center.

First, the flow of the scavenging air when the piston 21 is located in the bottom dead center will be explained with reference to FIGS. 2, 4 and 5. As shown in FIGS. 2, 4 and 5, in the state in which the piston 21 is located in the bottom dead center, the scavenging port 25*b* (the right scavenging port 25*b*R and the left scavenging port 25Bl) are open, scavenging air containing at least fuel and air flows from the scavenging air passage 25 into the intra-cylinder space 29 through the cylinder head 3, the cylinder 5 and the piston 21. As described above, the scavenging air passage 25 extends in the axial direction of the bore center line L1 of the cylinder 5, and has the scavenging port 25*b* that is open in the cylinder 5, so that most of the scavenging air flowing from the scavenging air hole 25*b* (flow S1) has an angular component toward the upper direction (see FIG. 2). As a result, when the piston 21 reaches the vicinity of the bottom dead center, thereby to release the scavenging port 25*b* from being closed by the piston 21, most of the scavenging air flowing from the scavenging port 25*b* (flows S1, S2 and S3) rushes into the intra-cylinder space 29 and hits the upper side surface in the anti-discharge direction with respect to the bore center line L1 of the cylinder 5 as the flow S1 shown in FIG. 2.

Then, the scavenging air creates a tumble flow that moves upward along the side surface of the cylinder 5 in the anti-discharge direction as the flow S1 of FIGS. 2 and 4. After that, the scavenging air flows toward the discharge port 27*a* (the top surface 21*a* of the piston 21) along the inner periphery of the cylinder head 3 and the side surface of the cylinder 5 in the anti-discharge direction, maintaining the strong power.

With the present embodiment, the piston concave portion 21*b* including the steep slope portion 21*b*-1 and the gentle slope portion 21*b*-2 is formed on the top surface 21*a*. Therefore, after moving along the side surface of the cylinder 5 in the anti-discharge direction and reaching the vicinity of the top surface 21*a*, first, the scavenging air is successfully guided to the deepest portion 21*b*-3 along the steep slope part 21*b*-1, and then is smoothly guided to the side surface of the cylinder 5 in the anti-discharge direction along the gentle slope part 21*b*-2. As a result, it is possible to prevent the scavenging air from directly discharging from the exhaust port 27*a*, and to swirl the scavenging air, creating a loop in the intra-cylinder space 29, as the flow S1.

In addition, as shown in FIGS. 2 and 5, with the present embodiment, the piston 21 moves to close the scavenging port 25*b* before and after the leading portion of the flow S1 of the scavenging air reaches the exhaust port 27*a*. With this flow S1 of the scavenging air in the intra-cylinder space 29 as described above, it is possible to effectively discharge the combustion gas C having been combusted in the combustion chamber 30 from the exhaust port 27*a* as the exhaust gas E (see FIG. 4).

Moreover, when the piston 21 moves from the bottom dead center to the top dead center, the exhaust port 27*a* is rapidly reduced by the Y-shaped wall surface 27*b*, and therefore it is possible to effectively prevent blow-by of the scavenging air.

Here, the flow of the scavenging air entering from the scavenging port 25*b* is not limited to the flow S1, but the other flows are possible: for example, the flow S3 which does not create a tumble flow but moves directly to the exhaust port 27*a*; and the flow S2 which, despite having create a tumble flow once, does not reaches the cylinder head 3 but diverges and moves to the exhaust port 27*a*.

Generally, these scavenging air flows S2 and S3 are directly discharged when, particularly, the piston 21 moves from the bottom dead center to the top dead center to close the discharge port 27*a*. However, with the present embodiment, it is possible to effectively prevent blow-by of these scavenging air flows. Hereinafter, the reason for that will be described separately between the flow S2 of the scavenging air and the flow S3 of the scavenging air.

First, the flow S2 of the scavenging air will be explained. As described above, although having created a tumble flow once, the flow S2 of the scavenging air does not reach the cylinder head 3 but moves to the exhaust port 27*a*. Then, when the flow S2 of the scavenging air reaches the vicinity of the side surface of the cylinder 5 in the discharge direction, it is captured by the flow S1 of the scavenging air. The flow of the captured scavenging air is changed from S2 to S1, and therefore the captured scavenging air is successfully guided to the side surface of the cylinder 5 in the anti-discharge direction, along the spherical shape of the piston concave portion 21*b* that is rising. In addition, even if the flow S2 of the scavenging air is not captured by the flow S1 of the scavenging air, the flow S2 of the scavenging air originates from the symmetric scavenging port 23*a*, and therefore the flow S2 of the scavenging air reaches a cylinder center plane D, that is, the center of the scavenging port, and hits the wall surface 27*b*, so that it is possible to prevent the flow S2 of the scavenging air from directly being discharged from the exhaust port 27*a*. In this case, the flow S2 of the scavenging air can be successfully guided to the side surface of the cylinder 5 in the anti-discharge direction, along the spherical shape of the piston concave portion 21*b* that is rising. Therefore, it is possible to effectively prevent blow-by of the flow S2 of the scavenging air.

Next, the flow S3 of the scavenging air will be explained with reference to FIGS. 2 and 4. As shown in FIGS. 2 and 4, the flow S3 of the scavenging air moves directly to the exhaust port 27*a*.

Before reaching the vicinity of the side surface of the cylinder 5 in the discharge direction, the flow S3 of the scavenging air enters the piston concave portion 21*b* that is rising, and is captured by the flow S1 of the scavenging air and the flow S2 of the scavenging air. Therefore, with the present embodiment, it is possible to effectively prevent blow-by of the flow S3 of the scavenging air.

As described above, with the present embodiment, the piston concave portion 21*b* is formed in the top surface 21*a* of the piston 21. Therefore, it is possible to effectively prevent various scavenging air flows (e.g. flows S1, S2 and S3) from being directly discharged from the discharge port 27*a*. The piston concave portion 21*b* has a steep slope in the discharge direction and a gentle slope in the anti-discharge direction, and, while the piston 21 rises, the gas flows from the steep slope part 21*b*-1 to the gentle slope part 21*b*-2 above the piston 21. Therefore, this gas flows in the anti-discharge direction via the piston concave portion 21*b*, and therefore it is possible to prevent blow-by.

Moreover, with the present embodiment, the Y-shaped wall surface 27*b* is formed in the exhaust port 27*a*, and therefore it is possible to hit at least part of the flow S1, S2 and S3 moving to the exhaust port 27*a* (particularly, the flow S1 and S2) against the wall surface 27*b* (see FIGS. 4 and 5). Therefore, with the present embodiment, as described above, by forming the piston concave portion 21*b* in the piston 21, so that it is possible to prevent blow-by of the scavenging air. In addition to this, by the combination of the piston concave portion 21*b* and the wall surface 27*b*, it is possible to more effectively prevent the blow-by of the scavenging air from the exhaust port 27*a*.

Next, the flow of the scavenging air when the piston 21 reaches the top dead center will be explained with reference to FIG. 3.

As shown in FIG. 3, with the present embodiment, when the piston 21 reaches the top dead center, the area S is formed with the gap W between the cylinder extending surface 3*c* and the piston extending surface 21*c*. Therefore, with the present embodiment, it is possible to allow a mixture of fuel and air to rush into the combustion chamber 30 via the area S, as flow S4 of FIG. 3. This air-fuel mixture flows into the combustion chamber 30 and therefore is effectively agitated, so that it is possible to increase the combustion speed and also the combustion pressure.

In addition, with the present embodiment, when the piston 21 reaches the top dead center, the approximately oval spherical combustion chamber 30 is formed between the piston concave portion 21*b* and the cylinder concave portion 3*b*. Therefore, when the air-fuel mixture with a squish flow enters the combustion chamber 30, this air-fuel mixture swirls, creating a loop, along the inner surface of the combustion chamber 30 as the flow S4. Therefore, the air-fuel mixture is more effectively agitated, and consequently it is possible to effectively improve the engine output.

In addition, the combustion chamber 30 has an approximately oval spherical inner shape, and therefore it is possible to reduce S/V ratio (surface volume ratio) in the early stage of the combustion. Thereby the thermal efficiency is improved, and therefore it is possible to improve the engine output.

Moreover, the electrode part 33*b* of the spark plug 33 is provided in the position on or near a combustion chamber center line L2 of the combustion chamber 30. That is, it is possible to effectively ignite the flow 4 of the air-fuel mixture coming into the combustion chamber 30 by the electrode part 33*b* of the spark plug 33, and therefore to more effectively improve the engine output.

<Embodiment 2>

Figure 6:
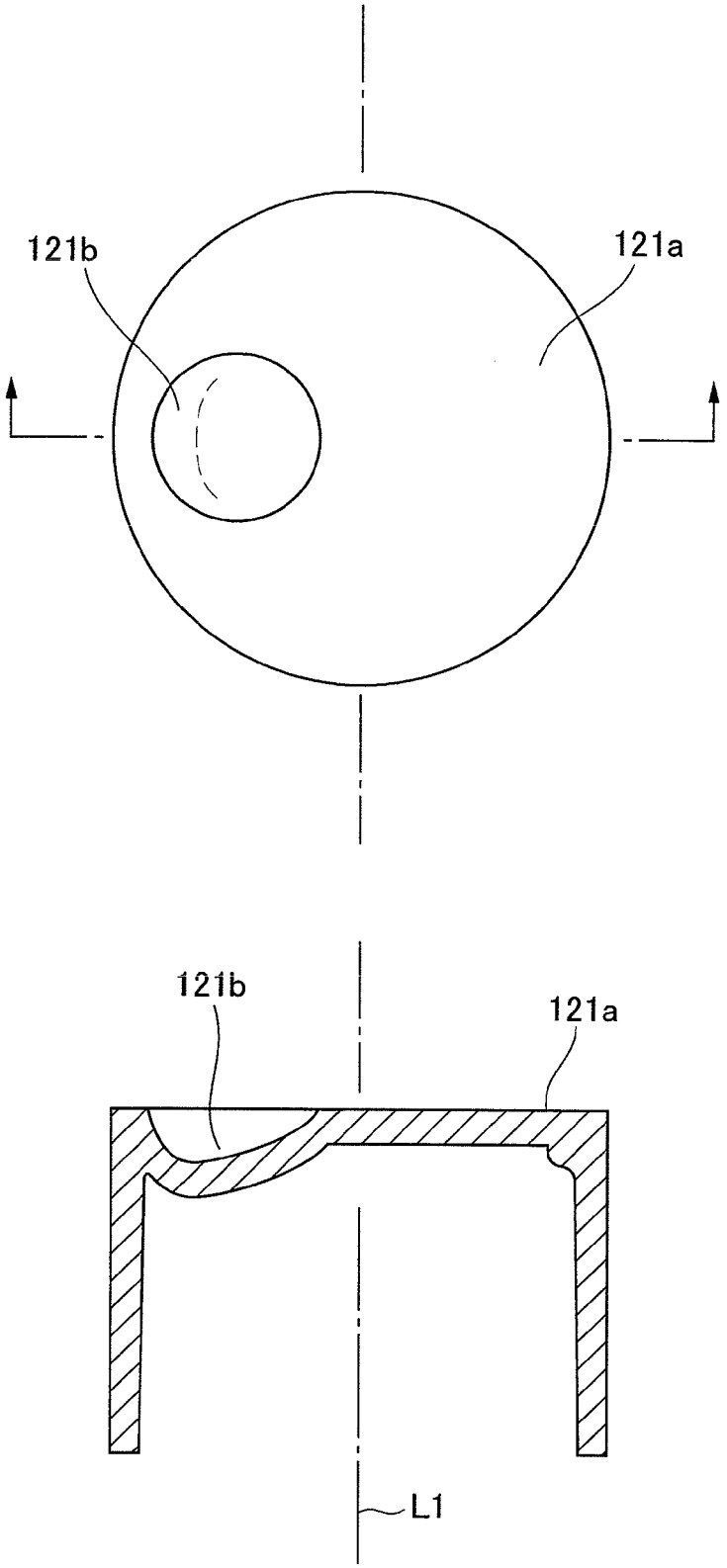
FIG. 6 is a drawing explaining Embodiment 2.

FIG. 6 is a drawing explaining Embodiment 2.

With the above-described Embodiment 1, a configuration has been described where the center (bore center line L1) of the top surface 21*a* is located in the piston concave portion 21*b* formed in an approximately circular shape in planar view. However, it is by no means limiting, but another configuration is possible according to Embodiment 2 shown in FIG. 6, as long as the center of the piston concave portion is located in the discharge direction with respect to the center of the top surface 21*a*, and the slope of the piston concave portion extending from the outer circumferential edge of the piston concave portion in the discharge direction to the deepest portion is steeper than the slope of the piston concave portion extending from the outer circumferential edge of the piston concave portion in the anti-discharge direction to the deepest portion. That is, the center of the top surface 121*a* may not be located in the piston concave portion 121*b* having an approximately circular shape in planar view. Here, with Embodiment 2, the entire surface of the piston concave portion 121*b* may be formed in an approximately spherical shape like Embodiment 1.

<Embodiment 3>

Figure 7:
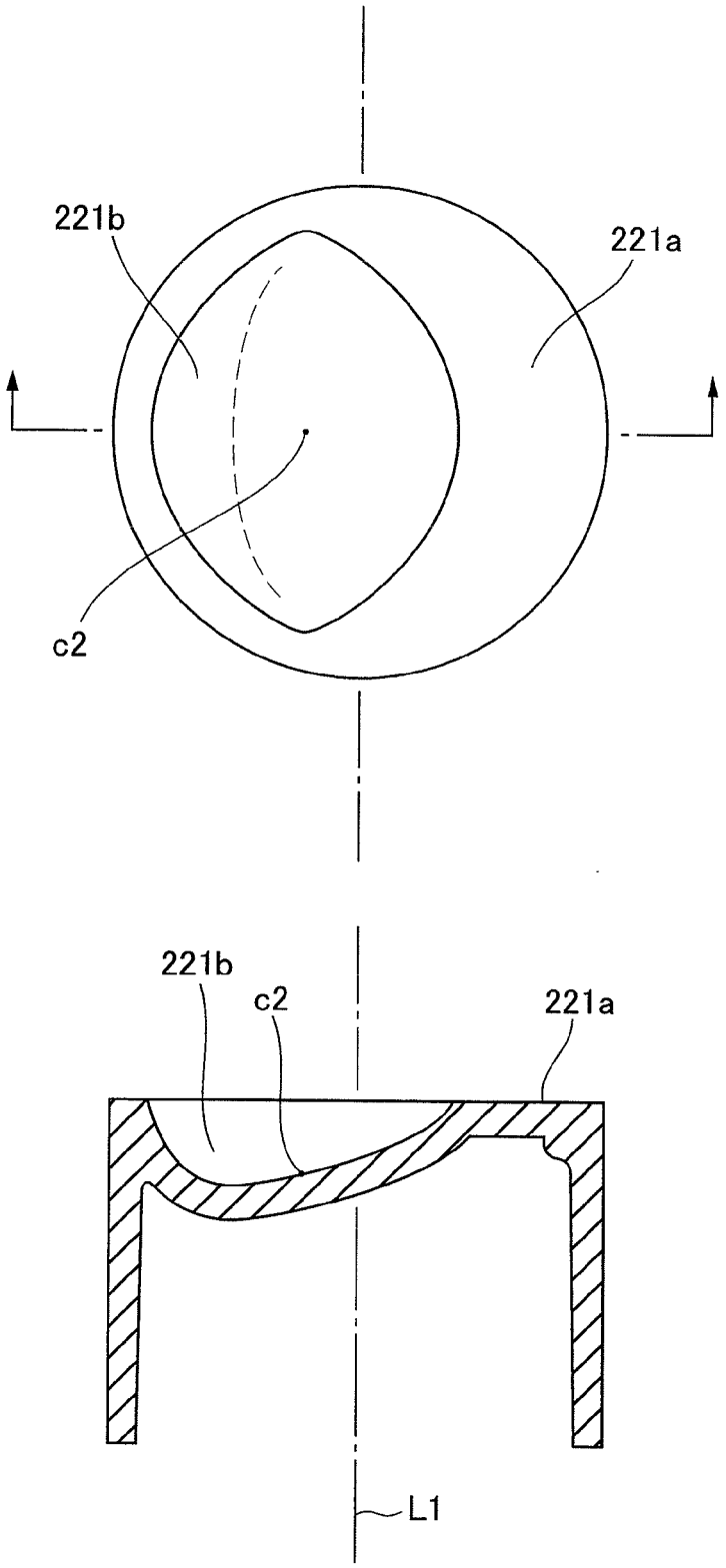
FIG. 7 is a drawing explaining Embodiment 3.

FIG. 7 is a drawing explaining Embodiment 3.

With the above-described embodiment 1, a configuration has been described where the piston concave portion 21*b* is formed in an approximately circular shape in planar view, and the center of the piston concave portion 21*b* is located in the exhaust port side with respect to the center of the top surface 21*a*. However, it is by no means limiting, but a piston concave portion as shown in FIG. 7 is possible according to Embodiment 3 as long as center c2 of a piston concave portion 221*b* is located in the discharge direction with respect to the center of a top surface 221*a*, and the piston concave portion is formed such that the slope of the piston concave portion extending from the outer circumferential edge of the piston concave portion in the discharge direction to the deepest portion is steeper than the slope of the piston concave portion extending from the outer circumferential edge of the piston concave portion in the anti-discharge direction to the deepest portion. That is, the piston concave portion 221*b* formed in the top surface 221*a* may have an approximately oval shape (like a rugby ball). Here, with Embodiment 3, the entire surface of the piston concave portion 221*b* may be formed in an approximately spherical shape like the above-described embodiments.

<Embodiment 4>

Figure 8:
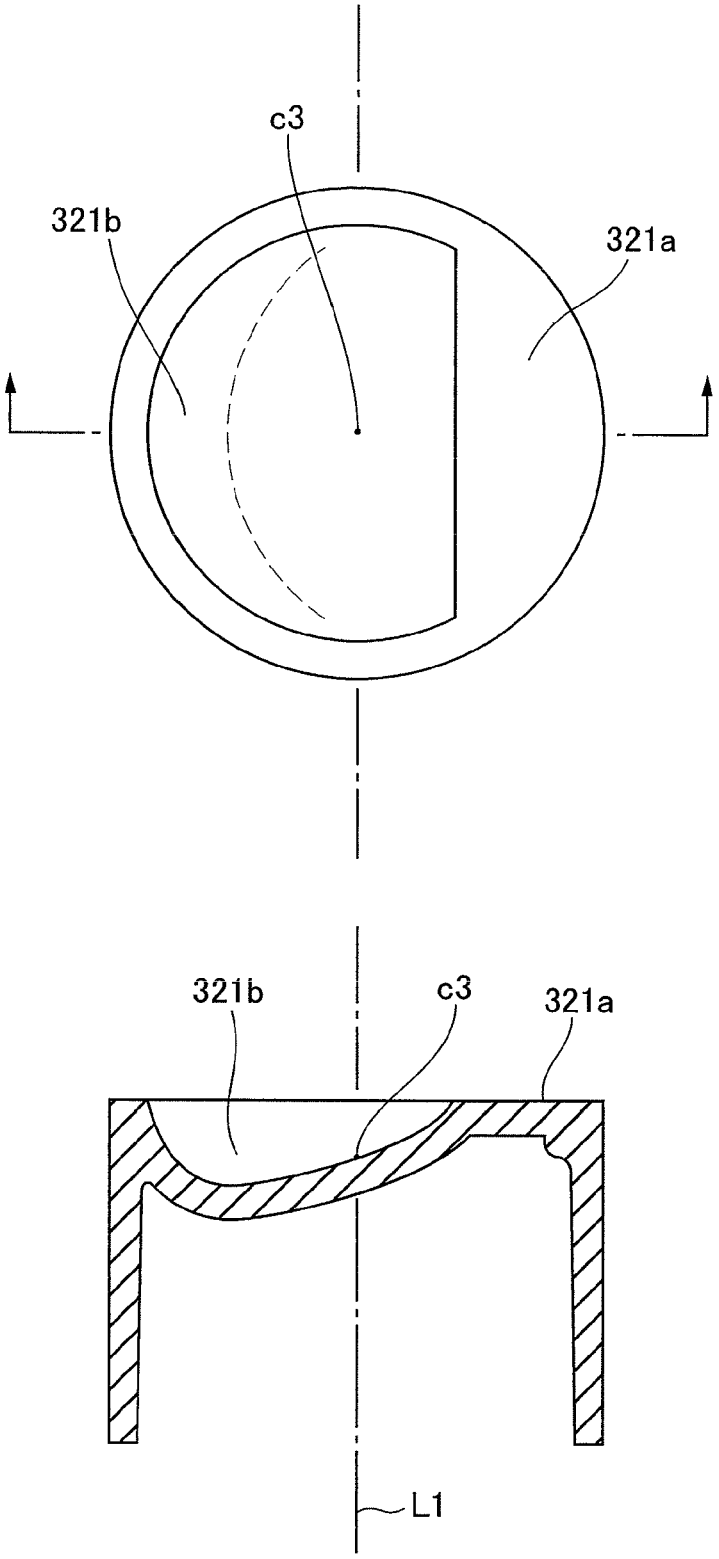
FIG. 8 is a drawing explaining Embodiment 4.
Figure 9:
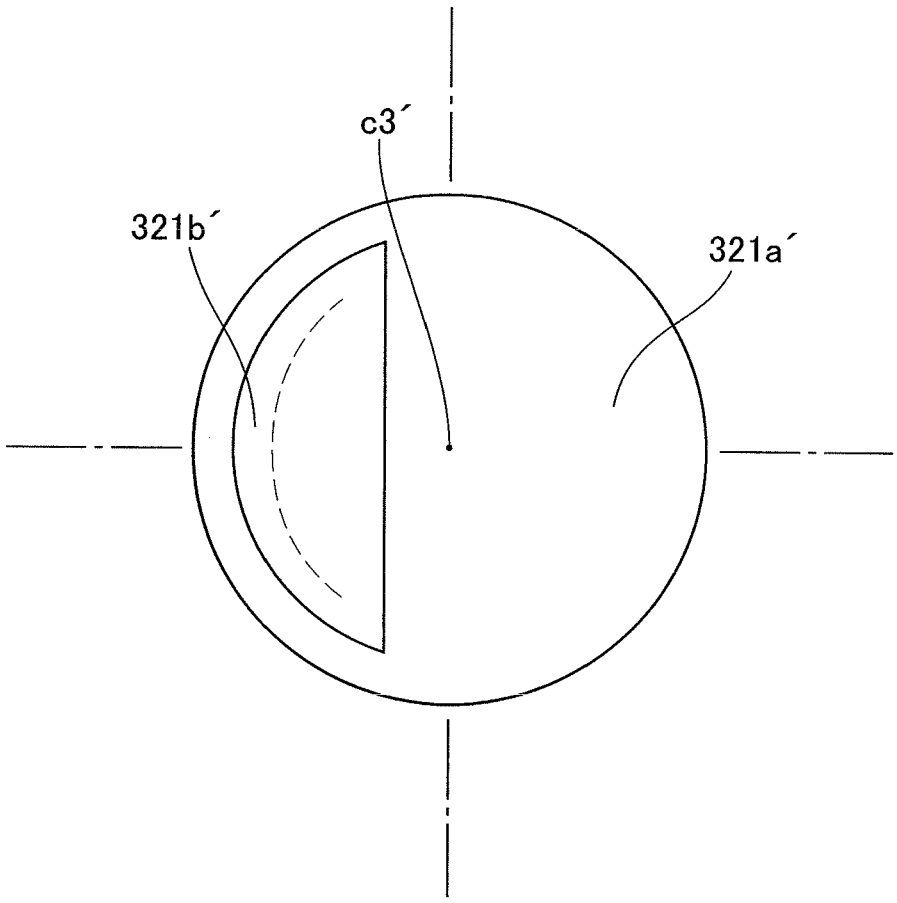
FIG. 9 is a drawing explaining a modification of Embodiment 4.
Figure 10:
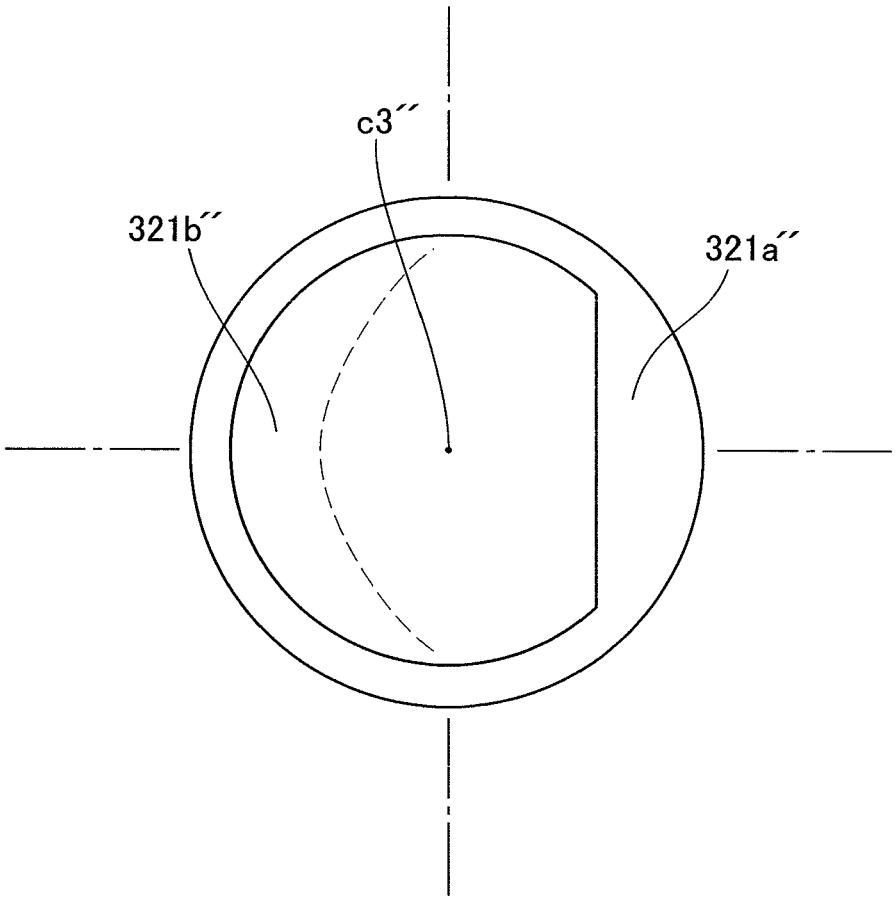
FIG. 10 is a drawing explaining a modification of Embodiment 4.

FIGS. 8 to 10 are drawings explaining Embodiment 4 and its modifications.

With the above-described Embodiment 1, a configuration has been described where the piston concave portion 21*b* is formed in an approximately circular shape in planar view, and its center is located in the exhaust port side with respect to the center of the top surface 21*a*. However, it is by no means limiting, but another configuration as shown in FIG. 8 is possible according to Embodiment 4, as long as the piston concave portion is formed such that the slope of the piston concave portion extending from the outer circumferential edge of the piston concave portion in the discharge direction to the deepest portion is steeper than the slope of the piston concave portion extending from the outer circumferential edge of the piston concave portion in the anti-discharge direction to the deepest portion. That is, center c3 of a piston concave portion 321*b* in a circular shape formed in a top surface 321*a* coincides the center of a top surface 321*a*, and the piston concave portion 321*b* is formed in an approximately D shape in planar view, which is obtained by cutting part of the piston concave portion 321*b* in the anti-discharge direction.

Moreover, Embodiment 4 shown in FIG. 8 may be modified as shown in FIGS. 9 and 10. Here, the modifications shown in FIGS. 9 and 10 are the same as Embodiment 4 shown in FIG. 8 in that the center c3 of the piston concave portion 321*b* coincides the center of the top surface 321*a*, and the piston concave portion 321*b* is formed in an approximately D shape in planar view. However, with the modification shown FIG. 9, the outer circumferential edge of a piston concave portion 321*b*' in the anti-discharge direction is shifted to the discharge direction compared to the outer circumferential edge of the piston concave portion 321*b* in the anti-discharge direction shown in FIG. 8; and with the modification shown in FIG. 10, the outer circumferential edge of a piston concave portion 321*b*" in the anti-discharge direction is located in the anti-discharge direction respect to the outer circumferential edge of the piston concave portion 321*b* in the anti-discharge direction shown in FIG. 8. Here, with Embodiment 4 and its modifications, the entire surface of the piston concave portion 321*b* (321*b*' and 321*b*") may be formed in an approximately spherical shape like the above describe embodiments.

<Embodiment 5>

Figure 11:
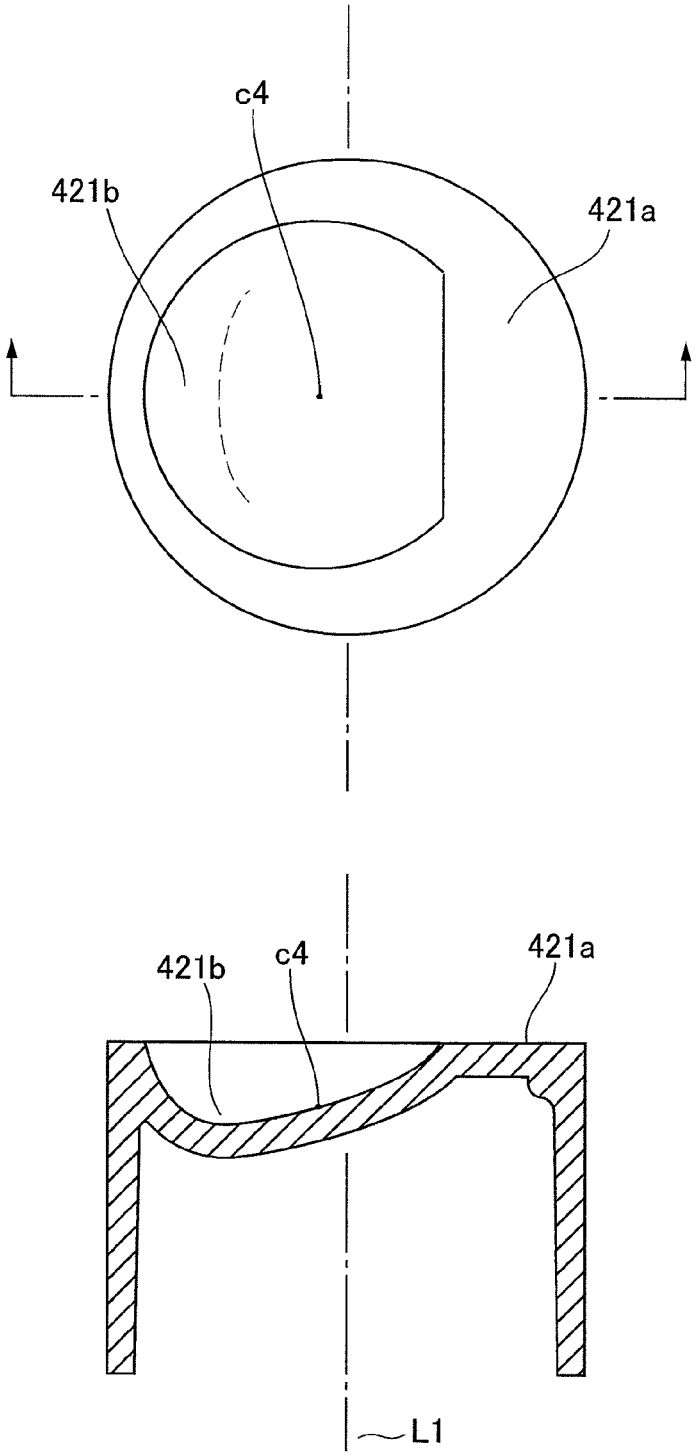
FIG. 11 is a drawing explaining Embodiment 5.
Figure 12:
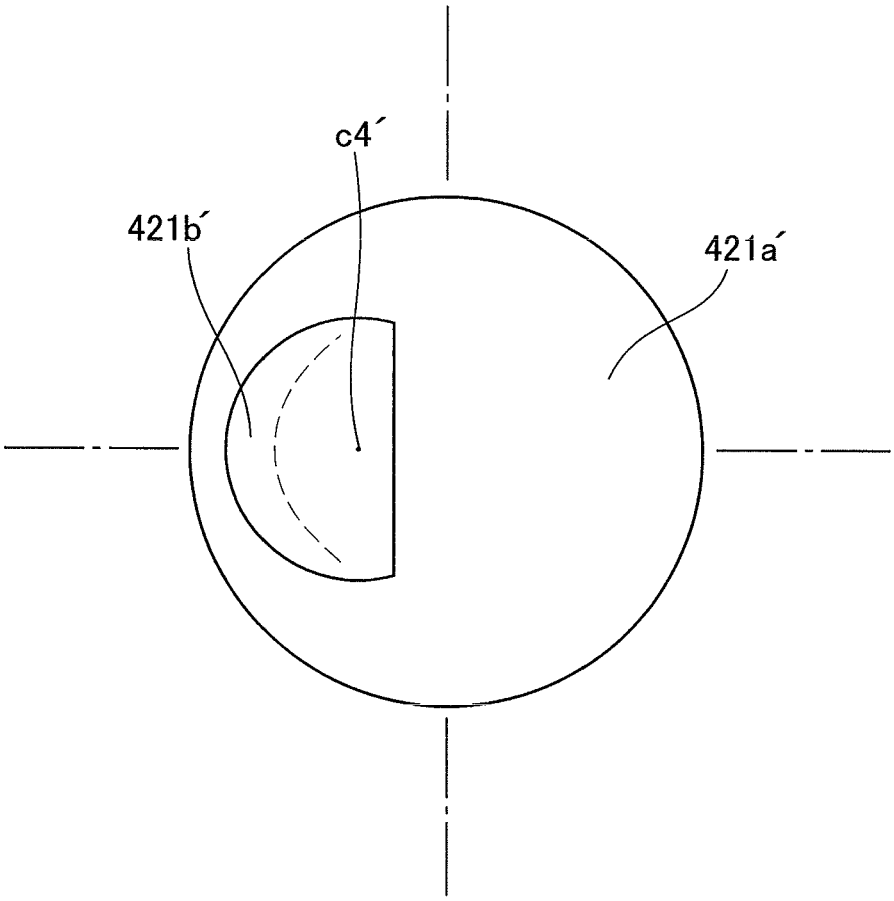
FIG. 12 is a drawing explaining a modification of Embodiment 5.

FIGS. 11 and 12 are drawings explaining Embodiment 5 and its modification.

With Embodiment 4, a configuration has been described where the center c3 of the piston concave portion 321*b* formed in an approximately D shape in planar view coincides the center of the top surface 321*a*. However, it is by no means limiting, but another configuration as shown in FIG. 11 is possible according to Embodiment 5, as long as the piston concave portion is formed such that the slope of the piston concave portion extending from the outer circumferential edge of the piston concave portion in the discharge direction to the deepest portion is steeper than the slope of the piston concave portion extending from the outer circumferential edge of the piston concave portion in the anti-discharge direction to the deepest portion. That is, center c4 of a piston concave portion 421*b* in formed in a top surface 421*a* may be shifted to the discharge direction with respect to the center of the top surface 421*a*.

In addition, Embodiment 5 shown in FIG. 11 may be modified as a modification shown in FIG. 12. Here, the modification shown in FIG. 12 is the same as Embodiment 5 shown in FIG. 11 in that the center c4 of the piston concave portion 321*b* is located in the discharge direction with respect to the center of the top surface 321*a*, and the piston concave portion is formed in an approximately D shape. However, the outer circumferential edge of a piston concave portion 421*b*' in the anti-discharge direction is shifted to the discharge direction compared to the outer circumferential edge of the piston concave portion 421*b* in the anti-discharge direction shown in FIG. 11. Here, with Embodiment 5 and its modification, the entire surface of the piston concave portion 421*b* (421*b*') may be formed in an approximately spherical shape.

<Embodiment 6>

Figure 13:
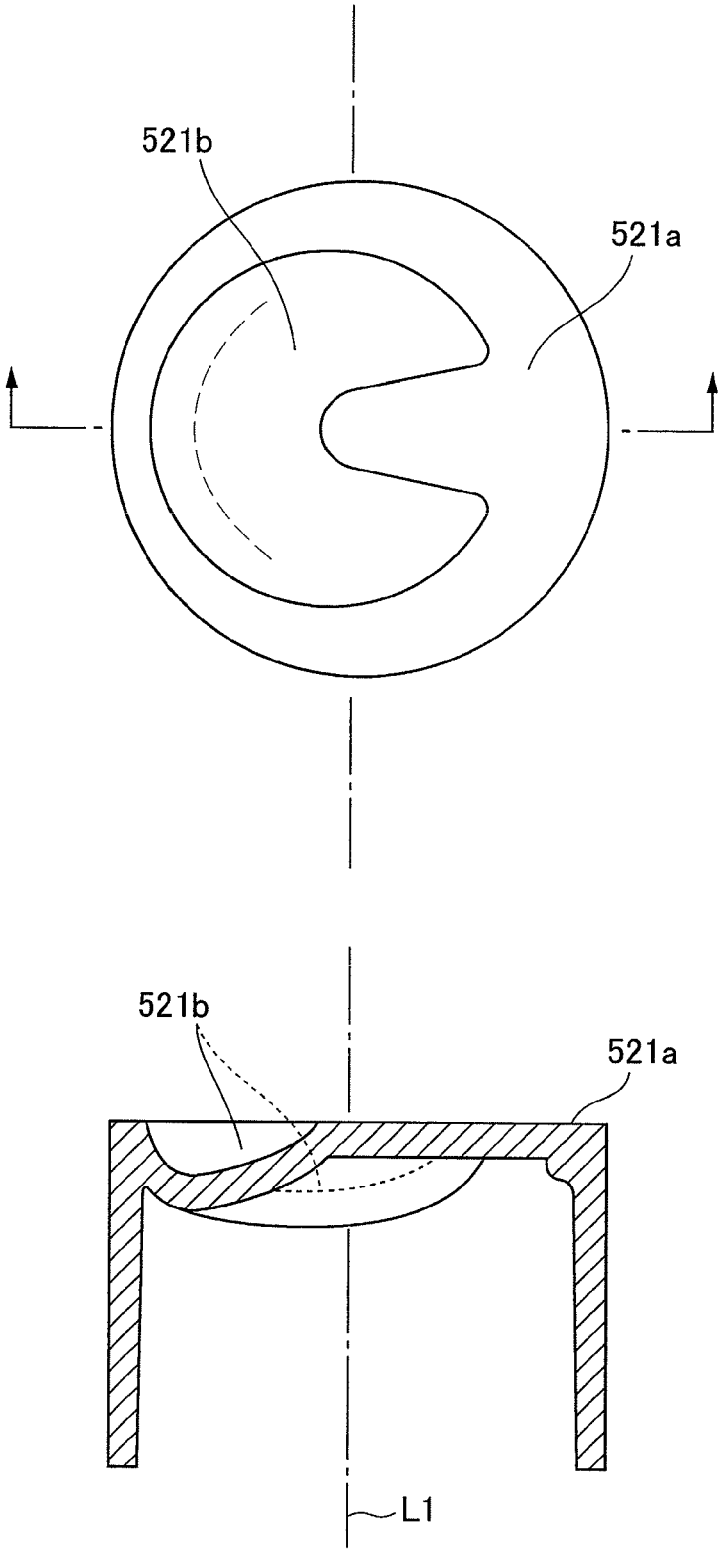
FIG. 13 is a drawing explaining Embodiment 6.
Figure 14:
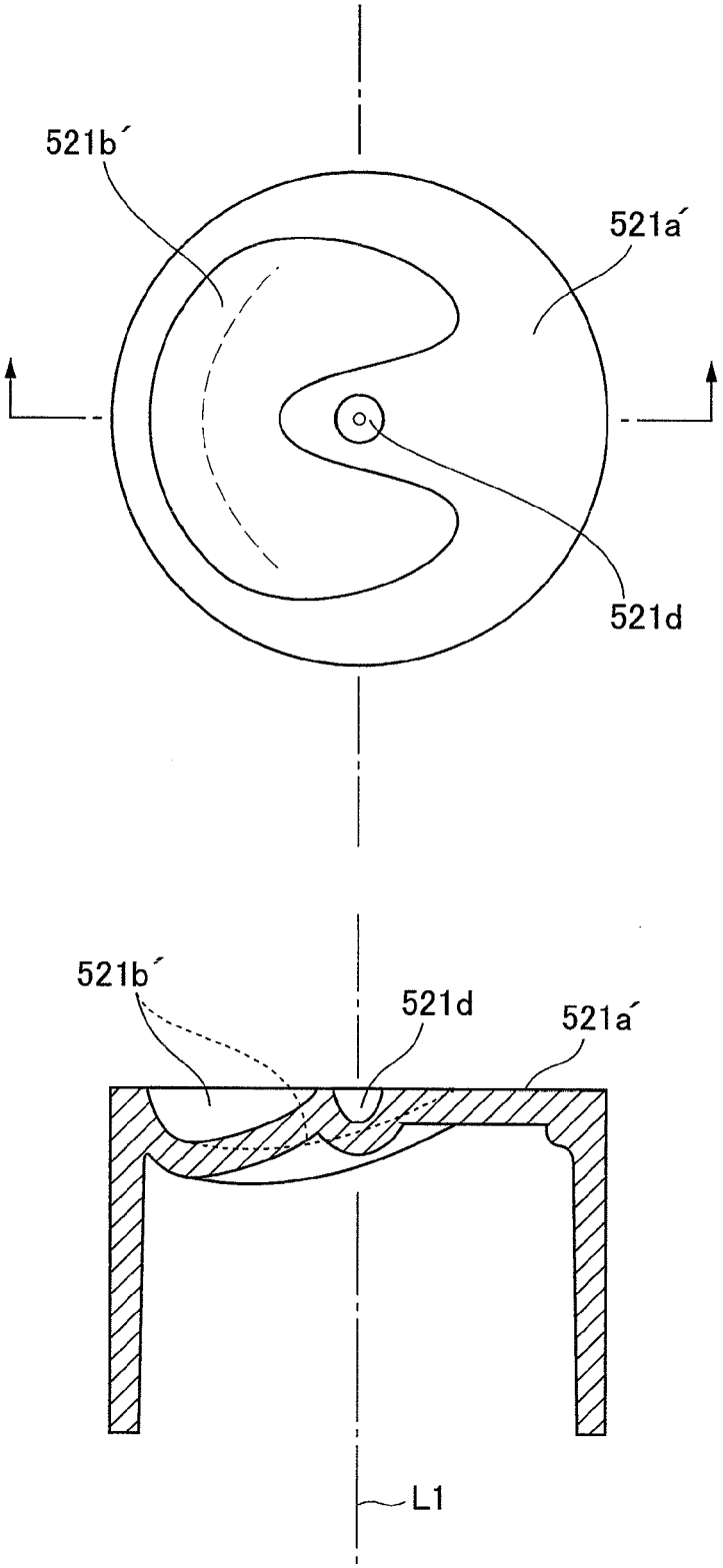
FIG. 14 is a drawing explaining a modification of Embodiment 6.

FIGS. 13 and 14 are drawings explaining Embodiment 6 and its modification.

With the above-described embodiments, the shape of the piston concave portion in planar view has been described where the piston concave portion is formed in an approximately circular shape (Embodiments 1 and 2), an approximately oval shape (Embodiment 3) and an approximately D shape (Embodiments 4 and 5). However, it is by no means limiting, but the piston concave portion may be formed in an approximately C shape as shown in FIG. 13. In this case, a piston concave portion 521*b* may be formed in a top surface 521 exclusive of the center of the top surface 521*a* a, like FIG. 13, as long as the piston concave portion is formed such that the slope of the piston concave portion extending from the outer circumferential edge of the piston concave portion in the discharge direction to the deepest portion is steeper than the slope of the piston concave portion extending from the outer circumferential edge of the piston concave portion in the anti-discharge direction to the deepest portion. By this means, it is possible to provide a center hole boss 521*d* that may be required to manufacture the piston 21. Here, with Embodiment 6, the entire surface of the piston concave portion 521*b* (521*b*') may be formed in an approximately spherical shape like the above-described embodiments.

<Embodiment 7>

Figure 15:
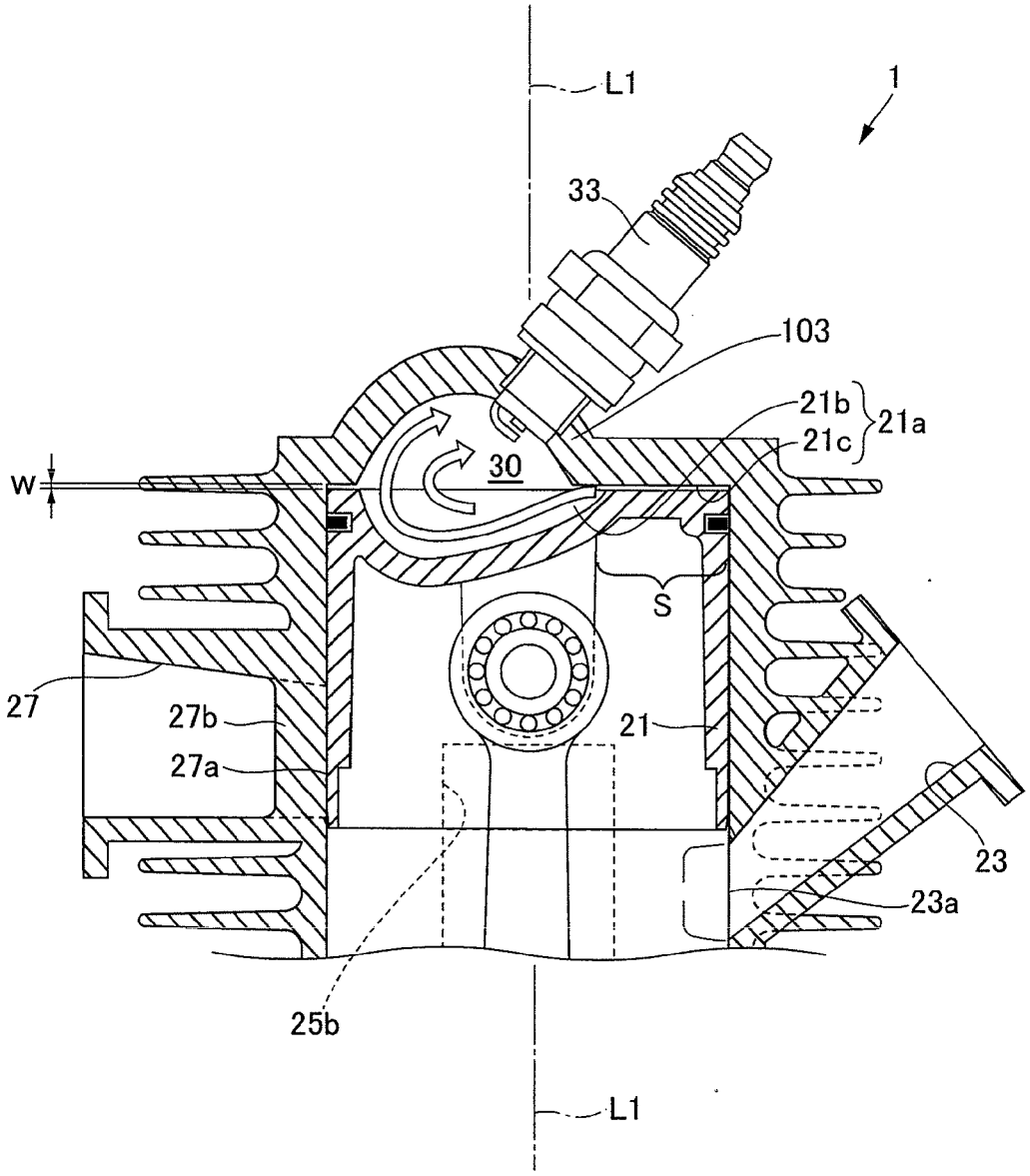
FIG. 15 is a drawing explaining Embodiment 7.

FIG. 15 is a drawing explaining Embodiment 7.

With Embodiment 1, a configuration has been explained where the entire outer circumferential edge of the cylinder concave portion 3*b* approaches the entire outer circumferential edge of the piston concave portion 21*b* while the piston 21 reaches the top dead center as shown in FIG. 3. However, it is by no means limiting, but another configuration is possible where, for example, only part of the outer circumferential edge of a cylinder concave portion 103*b* is formed to approach the outer circumferential edge of the piston concave portion 21*b* as shown in FIG. 15. Moreover, further another configuration is possible where the outer circumferential edge of the cylinder concave portion does not formed to approach the outer circumferential edge of the piston concave portion 21*b*, but is formed inside or outside the outer circumferential edge of the piston concave portion 21*b*, while the piston 21 reaches the top dead center (not illustrated).

<Configurations and Effects of the Embodiments>

The two-stroke engine 1 according to the present invention includes: the approximately cylindrical shaped cylinder 5 having the exhaust port 27*a* that can discharge exhaust gas and the scavenging port 25*b* that can deliver the scavenging air-fuel mixture in the direction approximately opposite to the discharge direction; and the piston 21 that can reciprocate between the top dead center and the bottom dead center in the cylinder 5. The top surface 21*a* of the piston 21 includes the approximately spherical piston concave portion 21*b* that is concave downward. Then, the entire surface of the piston concave portion 21*b* is formed in an approximately spherical shape. The piston concave portion 21*b* includes the steep slope portion 21*b*-1 from the outer circumferential edge of the piston concave portion 21*b* in the discharge direction to the deepest portion 21*b*-3, and the gentle slope portion 21*b*-2 from the outer circumferential edge of the piston concave portion 21*b* in the anti-discharge direction to the deepest portion.

With this configuration, it is possible to prevent blow-by of the scavenging air such as S1 to S3 from the exhaust port 27*a* as described above. As a result, it is possible to improve the trapping efficiency, the scavenging efficiency and the charging efficiency, and also improve the charging ratio (the amount of the entire gas in the cylinder/the capacity of the cylinder) and the modified delivery ratio (the amount of newly inspired gas/the amount of the entire gas in the cylinder), and therefore to improve the engine output while abating pollution. Moreover, it is possible to effectively prevent blow-by of the scavenging air containing fuel, and therefore to abate pollution.

In addition, with the embodiments, the piston concave portion 21*b* is formed such that half of the piston concave portion 21*b* in its diameter direction is located in the discharge port side with respect to the bore center line L1 of the cylinder 5.

With this configuration, the piston concave portion 21*b* can change the flow direction of the scavenging air such as the flow S1 moving around the exhaust port 27*a* to prevent the scavenging air from flowing toward the exhaust port 27*a*. Therefore, it is possible to effectively prevent blow-by of the scavenging air from the exhaust port 27*a*, and therefore to improve the engine output and also the thermal efficiency while abating pollution.

Moreover, with the present embodiment, the cylinder head 3 includes the cylinder concave portion 3*b* that is formed in part of the inner periphery of the cylinder head 3 facing the top surface 21*a* of the piston 21. The cylinder concave portion 3*b* is concave upward. The outer circumferential edge of the cylinder concave portion 3*b* is formed to approach the outer circumferential edge of the piston concave portion 21*b* when the piston 21 reaches the top dead center.

With this configuration, the approximately oval spherical combustion chamber 30 is formed between the piston concave portion 21*b* and the cylinder concave portion 3*b* when the piston 21 reaches the top dead center. That is, the flow 4 of the air-fuel mixture having entered the combustion chamber 30 moves, creating a loop, along the inner periphery of the approximately oval spherical combustion chamber 30 and then suitably agitated. Therefore, it is possible to improve the combustion speed and also the combustion pressure, and consequently to more effectively improve the engine output and the thermal efficiency.

In addition, with this configuration, the inner surface of the combustion chamber 30 is formed in an approximately oval spherical shape, and therefore it is possible to reduce the S/V ratio in the early stage of the combustion. As a result, it is possible to surely improve the engine output and thermal efficiency.

Moreover, with the present embodiment, the cylinder concave portion 3*b* is formed in a spherical shape.

With this configuration, it is possible to smoothly move the flow S4 of the air-fuel mixture having entered the combustion chamber 30 along the inner periphery of the combustion chamber 30. Therefore, it is possible to more effectively improve the engine output and the thermal efficiency.

Moreover, with the embodiments, the piston 21 includes the piston extending surface 21*c* that is formed in the top surface 21*a* of the piston 21, which extends from the outer circumferential edge of the piston concave portion 21*b* to the outside of the piston concave portion 21*b* in the diameter direction. Meanwhile, the cylinder 5 (cylinder head 3) includes the cylinder extending surface 3*c* formed in its inner periphery, which extends from the outer circumferential edge of the cylinder concave portion 3*b* to the outside of the piston concave portion 21*b* in the diameter direction and is provided such that the gap W is created between the cylinder extending surface 3*c* and the piston extending surface 21*c* when the piston 21 reaches the top dead center.

With this configuration, when the piston 21 reaches the top dead center, it is possible to allow the flow S4 of the air-fuel mixture to rush into the combustion chamber 30 formed by the piston concave portion 21*b* and the cylinder concave portion 3*b* via the gap W. That is, the air-fuel mixture is further agitated in the combustion chamber 30, and therefore it is possible to further improve the engine output and the thermal efficiency.

Moreover, with the embodiments, the gap W is sized to generate a squish flow.

With this configuration, the flow S4 of the air-fuel mixture having generated a squish flow in the combustion chamber 30 is further agitated in the combustion chamber 30, and therefore it is possible to surely improve the engine output and the thermal efficiency.

Moreover, with the embodiments, the combustion chamber 30 is provided such that the combustion center line L2 is located in the discharge direction with respect to the bore center line L1 of the cylinder 5 (see FIG. 2). That is, with the above-described embodiments, the cylinder concave portion 3*b* constituting the combustion chamber 30 is located in the discharge direction, and therefore it is possible to mount the spark plug 33 not only in the mounting hole 3*a*, but also in, for example, a mounting hole 3*a*' as shown in FIG. 2. In this way, with the embodiments, it is possible to improve the degree of freedom of mounting the spark plug 33 to the cylinder 5. Therefore, by setting the mounting location of the spark plug 33 appropriately for each of various machines, such as a working machine, it is possible to realize a space-saving two-stroke engine for the working machine and so forth.

Moreover, with the embodiments, the wall surface 27*b* is formed in the discharge port 27*a* to close at least part of the center portion of the discharge port 27*a* in the width direction.

This wall surface 27*b* makes the width of the exhaust port 27*a* provided between the cylinder head 3 side and the crank chamber 31 side greater than the total width of the exhaust port 27*a* in the cylinder head 3 side.

With this configuration, the scavenging air, which would be essentially discharged from the exhaust port 27*a*, can be circulated, and therefore it is possible to prevent blow-by of the scavenging air and improve the trapping efficiency, the charging efficiency, the engine output and also improve the performance of discharging exhaust gas.

Here, with the above-described embodiments, each of the surfaces which constitute the top surface 21*a* of the piston 21, including the outer periphery of the piston concave portion 21*b*; the piston extending surface 21*c*; and the surface of the cylinder 5 that faces the outer circumferential edge of the piston concave portion 21*b* and the piston extending surface 21*c* (the entire surface including the cylinder extending surface 3*c*, which extends from the outer circumferential edge of the cylinder concave portion 3*b*), is formed in an approximately flat shape, but it is by no means limiting. They may be formed in an approximately spherical shape. In this case, another configuration is possible where the outer periphery of the piston concave portion 21*b* or the piston extending surface 21*c* is approximately parallel to the above-described surface of the cylinder 5.

REFERENCE SIGNS LIST

1 two-stroke engine
3 cylinder head
3*a* mounting hole (mounting part)
3*b* cylinder concave portion
3*c* cylinder extending surface
5 cylinder
9 crankshaft
21 piston
21*a* top surface
21*b* piston concave portion
21*b*-1 steep slope portion
21*b*-2 gentle slope portion
21*b*-3 deepest portion
21*c* piston extending surface

23 intake passage
23*a* intake port
25 scavenging air passage
25*b* scavenging port
25*b*L left scavenging port
25*b*R right scavenging port
27 exhaust passage
27*a* exhaust port
27*a*L left exhaust port
27*a*R right exhaust port
27*b* wall surface
29 intra-cylinder space
30 combustion chamber
33 spark plug
L1 bore center line
L2 combustion chamber center line
C center of cylinder concave portion
D bore center plane

The invention claimed is:

1. A two-stroke engine comprising:

a cylinder provided with an approximately cylindrical shape; and a piston that can reciprocate between a top dead center position and a bottom dead center position in the cylinder, the cylinder including:

an exhaust port configured to be able to discharge exhaust gas; and a scavenging port configured to be able to deliver scavenging air containing fuel and air in an anti-discharge direction approximately opposite to a discharge direction of the exhaust gas, wherein:

the piston has a top surface, part of the top surface being concave and comprising a piston concave portion;

an entire surface of the piston concave portion having an approximately spherical shape; and a slope of the piston concave portion extending from an outer circumferential edge of the piston concave portion in the discharge direction, to a deepest portion, is steeper than a slope of the piston concave portion extending from an outer circumferential edge of the piston concave portion, in the anti-discharge direction, to the deepest portion;

the piston concave portion has a width dimension extending in the discharge direction and in the anti-discharge direction and orthogonal to a bore center line of the cylinder, and a half or larger portion of the width dimension is on the exhaust port side with respect to the bore center line.

2. The two-stroke engine according to claim 1, wherein the cylinder includes a cylinder concave portion that is concave in a direction in which the piston moves to the top dead center position, the cylinder concave portion is provided in an opposite surface that faces the top surface of the piston.

3. The two-stroke engine according to claim 2, wherein an outer circumferential edge of the cylinder concave portion approaches the outer circumferential edge of the piston concave portion when the piston reaches the top dead center position.

4. The two-stroke engine according to claim 2, wherein the cylinder concave portion has an approximately spherical shape.

5. The two-stroke engine according to claim 2, wherein:

the piston includes a piston extending surface in the top surface, the piston extending surface extending from the outer circumferential edge of the piston concave portion in the anti-discharge direction; and the cylinder includes a cylinder extending surface in the opposite surface, the cylinder extending surface extending from the outer circumferential edge of the cylinder concave portion in the anti-discharge direction, and having a gap between the cylinder extending surface and the piston extending surface when the piston reaches the top dead center position.

6. The two-stroke engine according to claim 5, wherein the gap is sized to generate a squish flow.

7. The two-stroke engine according to claim 2, wherein a mounting part is provided in the cylinder concave portion, the mounting part being configured to allow a spark plug to be mounted from an outside of the cylinder.

8. The two-stroke engine according to claim 7, wherein the mounting part is provided in the anti-discharge direction with respect to a center of the cylinder concave portion.

9. The two-stroke engine according to claim 1, wherein a wall surface is provided in the exhaust port to close at least part of a center portion of the exhaust port in a width direction.

10. The two-stroke engine according to claim 1, the scavenging port is provided in a lateral side wall of the cylinder.

11. The two-stroke engine according to claim 1, the exhaust port being located closer to a top of the cylinder than the scavenging port.

12. The two-stroke engine according to claim 1, at least a portion of the top surface, other than the piston concave portion, comprises a substantially planar surface extending in a direction transverse to a reciprocating direction of the piston.

13. The two-stroke engine according to claim 12, the piston concave portion is provided below the substantially planar surface.

* * * * *